United States Patent [19]

Schlegel

[11] 4,254,317

[45] Mar. 3, 1981

[54] ACTUATOR WITH ILLUMINATED KEY FOR ELECTRIC SWITCHING DEVICES, PARTICULARLY FOR CONTROL KEYS

[75] Inventor: Eberhard Schlegel, Durmentingen, Fed. Rep. of Germany

[73] Assignee: Firma Georg Schlegel, Durmentingen, Fed. Rep. of Germany

[21] Appl. No.: 82,750

[22] Filed: Oct. 9, 1979

[30] Foreign Application Priority Data

Oct. 13, 1978 [DE] Fed. Rep. of Germany ..... 2844579

[51] Int. Cl.[3] ..... H01H 9/18; H01H 9/22

[52] U.S. Cl. ..... 200/314; 200/328; 200/340

[58] Field of Search ..... 200/302, 310, 314, 340, 200/313, 5 A, 159 R, 160, 328

[56] References Cited

U.S. PATENT DOCUMENTS

| | | | |
|---|---|---|---|
| 2,668,893 | 2/1954 | Vaughan | 200/159 R |
| 3,188,437 | 6/1965 | Lauren et al. | 200/314 |
| 3,437,775 | 4/1969 | Piber | 200/314 |
| 3,596,033 | 7/1971 | Wickham | 200/302 |
| 3,598,948 | 8/1971 | Bowen | 200/302 |
| 4,112,277 | 9/1978 | Kleeb | 200/159 R |

*Primary Examiner*—John W. Shepperd

[57] ABSTRACT

An illuminated push button actuator for electrical switches is disclosed consisting of a housing, a plunger, and a spring to bias the plunger. The housing and plunger have projections which allow the plunger to be inserted from the front and rotated to latch the plunger in the housing. The housing has an upstanding flange and the plunger has a removable cap which are shaped to allow the plunger to be rotated to the unlatched position only when the cap has been removed.

4 Claims, 5 Drawing Figures

ACTUATOR WITH ILLUMINATED KEY FOR ELECTRIC SWITCHING DEVICES, PARTICULARLY FOR CONTROL KEYS

The invention relates to an actuator with illuminated key for electric switching devices, particularly for control-key switches, consisting of a housing which can be inserted into a control panel from the front and can be attached from the back, and of a plunger which is longitudinally displaceable inside the housing against the force of a spring and which is constructed in the shape of a cap for accommodating a signal lamp and is sealed off with respect to the housing, in which arrangement projections, overlapping one another radially and being releasable from one another by means of a rotation, at the housing and at the plunger lock the latter to prevent it falling out forward.

An actuator of this type is known from German Pat. No. 1,155,183. The plunger is here constructed of several parts, that is of a shell-shaped part and of a pushbutton screwed onto the former and forming the bottom of the cap. By unscrewing the pushbutton the signal lamp, which illuminates it from inside, can be replaced from the front. The shell-shaped part of the plunger is guided at the housing with the aid of recesses, provided in the plunger, in the manner of a bayonet lock, and corresponding associated projections at the housing, and is secured against twisting, and thus against falling out forward, by a guard located at the inside of the control panel.

It is the object of the invention to propose, in pursuance of the modern feeling for shape, an actuator having an angular, and more particularly square plunger head and a shroud which encloses the latter tightly, being watertight and containing a signal lamp which is accessible from the front for replacement purposes.

Since, given such an angular design, the plunger head cannot be turned in the housing the structure known before can be disregarded. It also has the disadvantage that the plunger is secured against accidentally jumping out of the housing only by utilising the associated switching device, so that during transport and manipulation of the actuator the risk exists, up until the switching device is mounted, that the structure will accidentally fall apart. In contrast to this, it is a further object of the invention to safeguard the actuator as a single component against falling apart, independently of its later use.

Starting with an actuator of the type described above in greater detail, these objects are achieved in accordance with the invention in that the plunger is constructed as a closed cap and is secured in the latched angular position by means of an additional plunger cap which can be locked on and is guided in the housing in a non-rotatable manner, and that the plunger can be rotated between the latched and an unlatched angular position if the plunger cap has been removed.

Firstly, constructing the plunger as a non-openable and preferably one-piece cap, in contrast to a shell-shaped plunger with a watertight cover lock, means considerable simplification. In connection with this, the signal lamp is made accessible due to the fact that the whole plunger can be taken out forward, even when the actuator is built in and the switching device is attached. The fact that the plunger head which is formed by the additional plunger cap in accordance with the invention, cannot be rotated with respect to the housing is utilised for securing the latching of the plunger in the housing. The plunger cap is suitably attached to the plunger with the aid of catches. If it is lifted off the plunger can be rotated and thus unlatched and pulled out forward.

According to preferred embodiments, the actuator can possess a rectangular or square shroud and a corresponding plunger cap. In this case it is particularly appropriate if a widened part, projecting into the shroud, of the plunger is also rectangular or square but with sides of a length which is smaller by as much as the inside dimension of the shroud so as to provide a rotatability which is adequate for unlatching. For a rectangular shape with sides of unequal lengths it is suggested, if necessary, to cut off obliquely two corners located diagonally opposite to one another. Thus the plunger simply needs to be turned until its widened part stops against the inside wall of the shroud and is then pulled out, or it then jumps out by itself under the action of its return spring.

As latching projections at the plunger and at the housing preferably four radial fins each, distributed around the periphery, are provided. With regard to sealing the plunger with respect to the housing, the simplest method is that mounting a sealing ring onto the plunger, particularly a lip seal ring, which rests against the cylindrical inside wall of the housing like a piston seal.

In the text which follows an illustrative embodiment of the invention is explained in greater detail with the aid of the drawing, in which.

Figure 1:
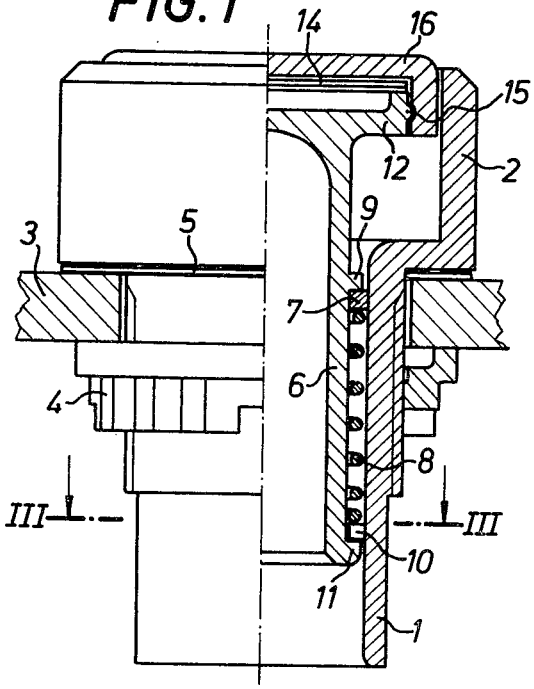
FIG. 1 shows in each half an axial section and the outside view of a complete actuator on a scale of 3:1.

The housing of the actuator according to FIG. 1 consists of a tubular stem 1 and a shroud 2 in the shape of a small square box. The tubular stem is pushed through a support wall 3. This support wall is clamped between a screw ring 4 and the shroud 2 for the purpose of attaching the actuator. A sealing disc 5 is inserted between the support wall and the shroud.

Inside the tubular stem 1 a one-piece cap-shaped plunger 6 moves which is encircled by a sealing ring 7. This sealing ring is pressed against an outer collar 9 of the plunger 6 by a compression spring 8, which also encircles the plunger, and seals the plunger with respect to the tubular stem 1 so that moisture and dust cannot penetrate into the tubular stem 1 from the inside space of the shroud 2. The bottom of the compression spring 8 is supported on four fins 10 which project radially inward from the tubular stem 1. The lower end of the plunger is provided with four similar fins 11 projecting radially outwards, which are a little narrower and pass between the gaps of the fins 10.

The upper end of the plunger 6 widens to a square plate 12 possessing an edge 13 projecting slightly upward and running all around. Onto this edge a translucent disc 14 is placed onto which a switch symbol is printed or which is supplemented by a clear-as-glass transparent designation label. To each of the four lateral edges of the plate 12 a longitudinal detent 15 is attached. A plunger cap 16 possessing at its inside edges corresponding recesses which accommodate the detents 15, is locked onto the plate 12 from above. The plunger cap 16 is also translucent and preferably coloured.

It is also pointed out that a signal lamp projects from the associated switching device, not shown, into the cavity of the plunger 6 which itself is also manufactured of transparent plastic and acts in its upper part as a diffusion screen so that the plunger cap is illuminated evenly from the inside and the above-mentioned opaque switch symbol is clearly visible.

Figure 4:
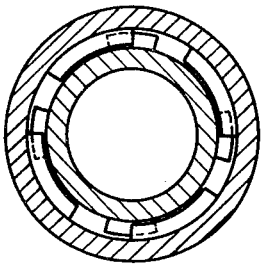
FIG. 4 shows a cross-section as in FIG. 3 in the latched angular position of the plunger.

In FIG. 1 the edges of the plate 12 run parallel to the walls of the shroud 2. The plunger cap 16 is mounted. In this position the fins 11 of the plunger assume the position shown in FIG. 4 with respect to the fins 10 of the tubular stem, that is to say they partially overlap. The fins thus prevent the plunger 6, together with its plunger cap 16, from being pushed out upward under the action of the compression spring 8. In this condition it is not possible to rotate the plunger about its axis since the square plunger cap 16 rests against the shroud 2 with only little lateral play. The actuator, therefore, forms a self-contained assembly of parts, none of which can be lost.

Figure 3:
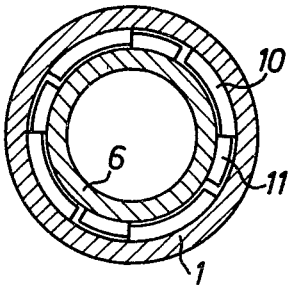
FIG. 3 shows a cross-section III—III in the unlatched angular position of the plunger according to FIG. 2.
Figure 2:
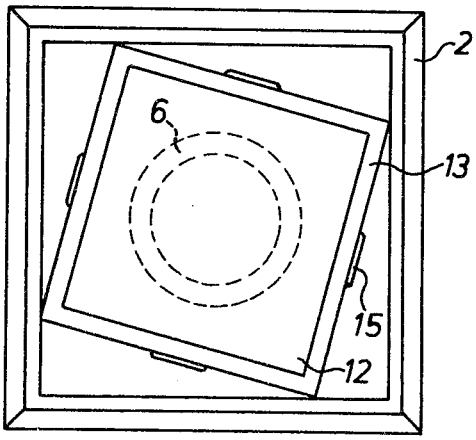
FIG. 2 shows the top view of the actuator according to FIG. 1 with its plunger cap removed and the plunger unlatched.

If in the built-in state according to FIG. 1 the above-mentioned signal lamp is to be replaced from the front, that is from above in the drawing, a knife-like tool is used to lift up the plunger cap 16 and to unlock it while doing so. It must be considered as an advantage that this will be done only by an expert who is familiar with the construction, but that the layman will find nothing to take off or screw off. After the plunger cap has been removed with the above-mentioned tool, the plunger can be gripped by the plate 12, turned to the right up to the stop (FIG. 2) and then pulled out. The relative angular position of the fins 10 and 11 according to FIG. 3 corresponds to the angular position according to FIG. 2. The compression spring 8 remains on the plunger 6 taken out. It is now supported on the fins 11, however.

After the signal lamp has been replaced the plunger 6, the disc 14 and the plunger cap 16 are assembled in the reverse order. Furthermore, the actuator is assembled in the same manner also during the production.

Figure 5:
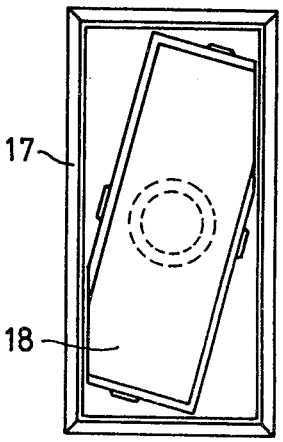
FIG. 5 shows a top view as in FIG. 2 of a different actuator on a smaller scale.

FIG. 5 shows an actuator with a rectangular shroud 17, the lengths of the outer sides having the relationship of 1:2. The plate 18 developed at the plunger and drawn here, too, in the unlatched position, is cut off obliquely at two corners diametrically opposite to one another, in order to obtain the necessary angle of rotation. If the fully rectangular plunger cap, not shown, is attached the cut-off corners cannot be seen.

LIST OF DESIGNATIONS

1—Tubular stem
2—Shroud
3—Support wall
4—Screw ring
5—Sealing disc
6—Plunger
7—Sealing ring
8—Compression spring
9—Collar
10—Fin (1)
11—Fin (6)
12—Plate
13—Edge
14—Disc
15—Detent
16—Plunger cap
17—Shroud
18—Plate

I claim:

1. Actuator with illuminated key for electric switching devices, particularly for control-key switches, consisting of a housing which can be inserted into a control panel from the front and can be attached from the back, and of a plunger which is longitudinally displaceable inside the housing against the force of a spring and which is constructed in the shape of a cap for accommodating a signal lamp and is sealed off with respect to the housing, in which arrangement projections, overlapping one another radially and being releasable from one another by means of a rotation, at the housing and at the plunger to lock the latter against falling out forward, characterised in that the plunger (6) is constructed as a closed cap and is secured in the latched angular position by means of an additional plunger cap (16) which can be locked on and is guided in the housing in a non-rotatable manner, and that the plunger can be rotated between the latched (FIG. 4) and an unlatched (FIG. 3) angular position if the plunger cap has been removed.

2. Actuator according to claim 1 possessing a rectangular shroud and a rectangular plunger cap, characterised in that a widened part (12; 18), projecting into the shroud (2; 17), of the plunger (6) is essentially also rectangular, but with sides the length of which is smaller by as much as the inside dimension of the shroud, or the corners of which are cut off so as to provide a rotatability which is adequate for unlatching.

3. Actuator according to one of the preceeding claims, characterised in that as latching projections at the plunger (6) and at the housing (1) four radial fins each (10, 11) are provided which are distributed around the periphery.

4. Actuator according to claim 1, characterized in that the plunger (6) is encircled by a sealing ring (7) which rests against the cylindrical inner wall of the housing (1).

* * * * *